United States Patent [19]

Poppke

[11] 4,227,344

[45] Oct. 14, 1980

[54] AUTOMATIC PARKING LOT GATE WITH FOUR-WAY FLEX CONNECTOR

[76] Inventor: David Poppke, 1414 N. 16th St., Bismarck, N. Dak. 58501

[21] Appl. No.: 12,330

[22] Filed: Feb. 15, 1979

[51] Int. Cl.[2] ..... E01F 13/00

[52] U.S. Cl. ..... 49/9; 49/34; 49/147

[58] Field of Search ..... 49/34, 9, 35, 49, 147, 49/149, 141, 26, 93, 247, 386

[56] References Cited

U.S. PATENT DOCUMENTS

| | | | |
|---|---|---|---|
| 1,535,753 | 4/1925 | Weiser | 49/9 X |
| 1,665,157 | 4/1928 | Dahnke | 49/9 X |
| 1,886,719 | 11/1932 | Oaks et al. | 49/247 |
| 2,839,791 | 6/1958 | Lee | 49/147 |
| 2,874,493 | 2/1959 | Mandel | 49/34 |
| 3,040,457 | 6/1962 | Rothvoss | 49/386 X |

*Primary Examiner*—Philip C. Kannan

*Attorney, Agent, or Firm*—Kinney, Lange, Braddock, Westman and Fairbairn

[57] ABSTRACT

A parking lot gate is provided with a flexible connector between the elongated gate arm and the arm drive mechanism to prevent breakage of the gate arm or the arm drive mechanism. The flexible connector includes a first connection plate connected to the arm drive mechanism, a second connection plate connected to the gate arm, and first and second coil springs connected between the first and second connection plates. The first and second coil springs are positioned essentially parallel to one another and in an essentially vertical plane.

15 Claims, 10 Drawing Figures

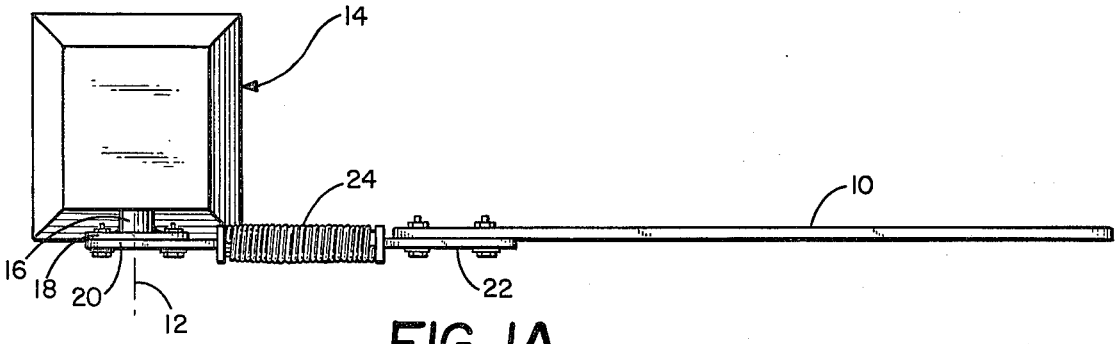
FIG. 1A
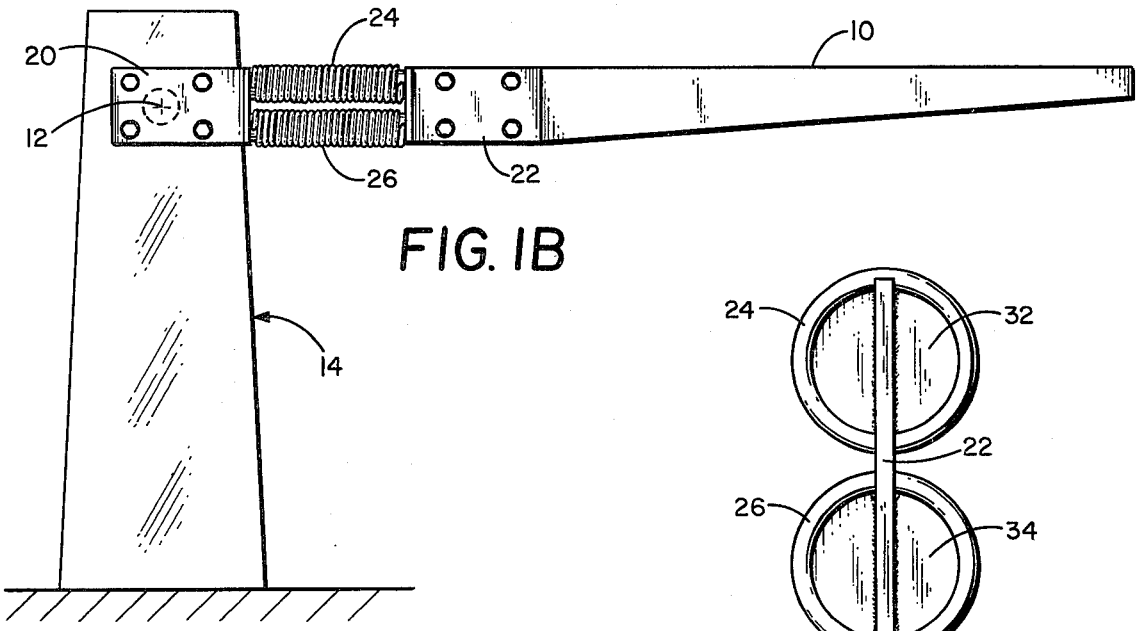
FIG. 1B
FIG. 2B
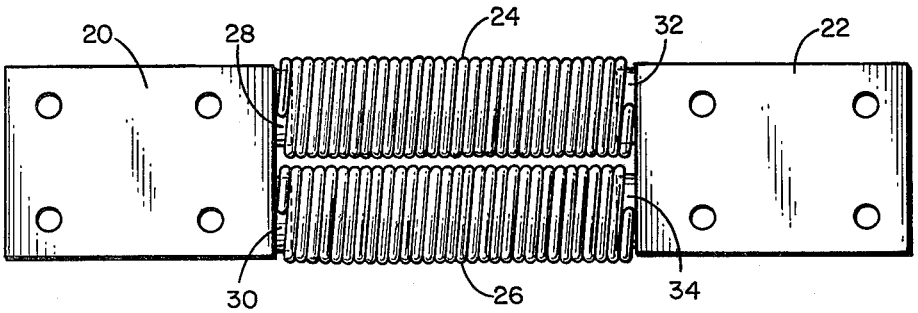
FIG. 2A

AUTOMATIC PARKING LOT GATE WITH FOUR-WAY FLEX CONNECTOR

SUMMARY OF THE INVENTION

The present invention is an improved parking lot gate which overcomes the problems of the prior art, breakaway gate arms.

In the present invention, a special flexible connector is connected between an elongated gate arm and arm drive means which selectively pivots the gate arm about a pivot axis in an essentially vertical plane. The special flexible connector includes first and second connection plates which are connected to the arm drive means and the gate arm, respectively, and first and second coil springs which are connected between the first and second connection plates. Each coil spring has its first end connected to the first connection plate and its second end connected to the second connection plate. The first and second coil springs are positioned essentially parallel to one another in an essentially vertical plane.

In the preferred embodiments of the present invention, the coil springs preferably together have sufficient strength to maintain the gate arm in its essentially horizontal position, but individually do not have sufficient strength to hold it in a horizontal position. As a result of the orientation and strength of the first and second coil springs, the gate arm may be more readily flexed in a horizontal plane than in a vertical plane.

In still further preferred embodiments, special inserts extend into the first and second ends of the coil springs to connect the coil springs to the connection plates. The inserts may be either permanently connected to the springs or may have threaded portions to receive and hold the ends of the springs.

BRIEF DESCRIPTION OF THE DRAWINGS

FIGS. 1A and 1B are top and front views of a parking lot gate apparatus utilizing the four-way flex connector of the present invention.

FIGS. 2A and 2B show front and end views of a first preferred embodiment of the four-way flex connector.

DETAILED DESCRIPTION OF THE PREFERRED EMBODIMENTS

Figure 3A:
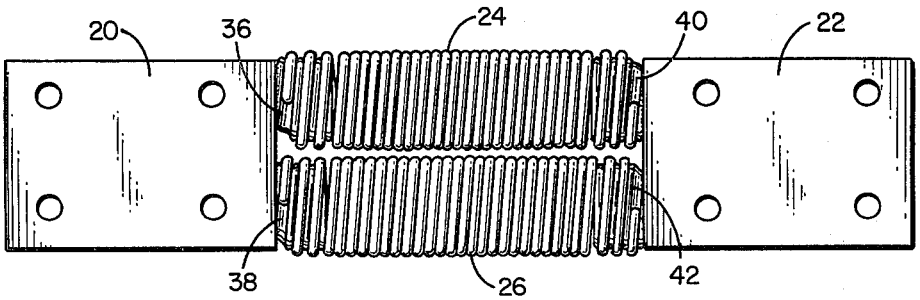
FIGS. 3A and 3B show front and side views of a second preferred embodiment of the four-way flex connector of the present invention.

In FIGS. 1A and 1B, a parking lot gate apparatus using the present invention is shown. The apparatus includes an elongated gate arm 10 which is pivoted about pivot axis 12 by an arm drive apparatus 14. Within arm drive apparatus 14 is a motor (not shown) which selectively rotates shaft 16, which is oriented with and defines the pivot axis. Attachment plate 18 is affixed to the end of shaft 16.

Unlike the prior art parking lot gate apparatus, gate arm 10 is not directly connected to attachment plate 18. Instead, first connection plate 20 is connected to attachment plate 18 by bolts and nuts or other suitable fasteners, and second connection plate 22 is connected to one end of gate arm 10. First and second coil springs 24 and 26 are connected between connection plates 20 and 22.

In the preferred embodiment of the present invention shown in FIGS. 1A and 1B, coil springs 24 and 26 are arranged essentially parallel to one another and oriented in an essentially vertical plane. The multiple spring configuration utilized in the present invention has important advantages. First, it has been found that in order to provide a single spring of sufficient strength to maintain a typical gate arm 10 in a horizontal position, the spring tends to be too stiff, and resists movement of gate arm 10 in a horizontal plane. Because the purpose of the invention is to avoid both breakage of gate arm 10 and damage to arm drive apparatus 14, it is desirable that the spring have greater flexibility in a horizontal plane than in a vertical plane.

The multiple spring configuration of the present invention achieves this goal. By utilizing two springs parallel to one another and arranged in an essentially vertical plane, neither of the two springs needs to have sufficient strength by itself to hold gate arm 10 in an essentially horizontal position. Instead, their combined strength in the vertical plane must be sufficient to hold plate arm 10 in a horizontal position. When a car drives through the gate with gate arm 10 down, thereby causing deflection in a horizontal plane, much less strength is presented, since the two springs are oriented parallel to one another in a vertical rather than a horizontal plane.

In other embodiments of the present invention, more than two coil springs are used. The number of coil springs depends upon the length and weight of the gate arm and the strength of the individual coil springs. As in the embodiment shown in FIGS. 1A and 1B, the coil springs are arranged parallel to one another in an essentially vertical plane.

The parking lot gate of the present invention has proved to be particularly effective in reducing damage to parking lot gate arms and arm drive mechanisms. Because a car can drive through the gate without breaking either gate arm or arm drive mechanism, the amount of maintenance and repairs of the parking lot gate are significantly reduced.

Although it is true that an unauthorized person can drive through the parking lot gate of the present invention, in practice this does not appear to be a significant problem. In most cases, the damage to unattended parking lot gates is produced by authorized parkers who merely have forgotten their key or card, rather than unauthorized parkers. The gate arm with the flexible connector of the present invention provides a sufficient deterrent to persons who are not authorized to park in the parking lot, while eliminating the breakage problems which have existed with the prior art parking lot gates.

In the preferred embodiments of the present invention, coil springs 24 and 26 are tightly wound torsion coil springs. The advantage of tightly wound coil springs is that they stabilize the gate arm. Although coil springs which are not tightly wound may also be used, I have found that they permit the gate arm to "quiver" or vibrate due to wind and whenever the gate arm is moved. Tightly wound coil springs eliminate this vibration.

The flexible connector of the present invention is shown in three different preferred forms in FIGS. 2A and 2B, 3A and 3B, and 5A and 5B. In these Figures, similar reference numers have been used to designate similar elements. In the first embodiment shown in FIGS. 2A and 2B, coil springs 24 and 26 are permanently connected to first and second plates 20 and 22. In the second embodiment shown in FIGS. 3A and 3B, as well as in the third embodiment shown in FIGS. 5A and 5B, springs 24 and 26 are threaded on special threaded inserts which in turn are connected to the connecting plates 20 and 22.

In FIGS. 2A and 2B, spring insert discs 28 and 30 are attached to one edge of first connection plate 20, and spring insert discs 32 and 34 are attached to one edge of second connection plate 22. Insert discs 28, 30, 32 and 34 are circular in shape, and have a diameter which is approximately equal to the inside diameter of springs 24 and 26 so as to form a snug fit into the ends of springs 24 and 26. In the embodiment shown in FIGS. 2A and 2B, spring insert discs 28 and 30 are welded to connection plate 20 and extend into and are welded to the first ends of springs 24 and 26, respectively. Similarly, spring insert discs 32 and 34 are welded to second connection plate 22 and to the second ends of springs 24 and 26, respectively.

In one successful version of the embodiment shown in FIGS. 2A and 2B, coil springs 24 and 26 were tightly wound, torsion coil springs approximately 5/16 inch wire diameter, $2\frac{1}{2}$ inch outside diameter, and 11 5/16 inch free length. Plates 20 and 22 were $\frac{1}{4}$ inch$\times$5 inch$\times$6 or 8 inch hot rolled, low carbon steel. Spring insert discs 28, 30, 32 and 34 were $\frac{3}{8}$ inch thick$\times 1\frac{7}{8}$ inch diameter hot rolled, low carbon steel and were welded to the ends of plates 20 and 22 so that they may be removed and replaced, and so that the four-way flex connector may be easily assembled and disassembled. In addition, the embodiment of FIGS. 3A and 3B eliminate any need for welding springs 24 and 26.

In this embodiment of the present invention, threaded spring inserts 36 and 38 are connected to first connection plate 20, and threaded spring inserts 40 and 42 are connected to second connection plate 22. In the embodiment shown in FIGS. 3A and 3B, threaded spring inserts 36 and 38 are welded to one edge of first connection plate 20, and threaded spring inserts 40 and 42 are welded to one edge of second connection plate 22.

Figure 3B:
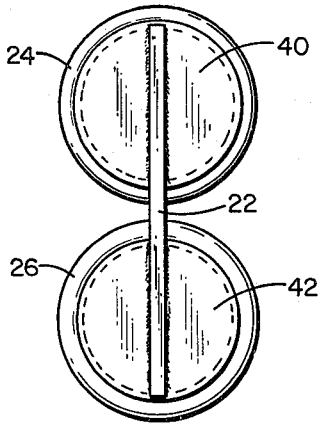
Figure 4A:
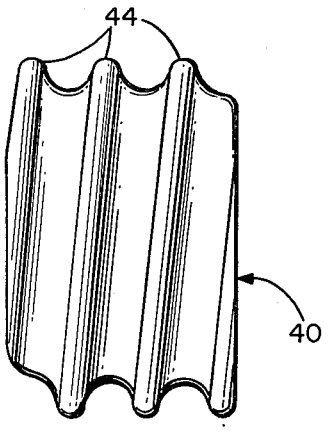
FIGS. 4A and 4B show side and end views of an insert having externally threaded portions which engage the inner end portions of the coil springs.
Figure 4B:
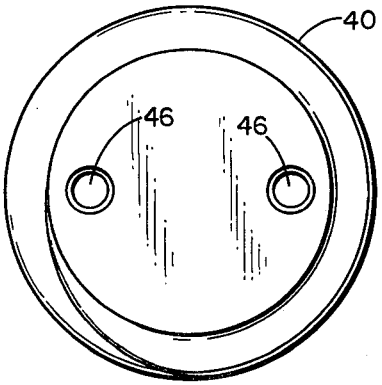
Figure 5A:
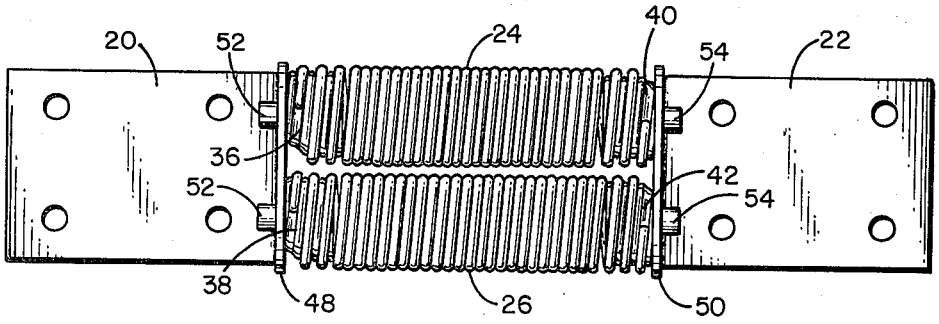
FIGS. 5A and 5B show front and end views of a third preferred embodiment of the flex connector of the present invention.
Figure 5B:
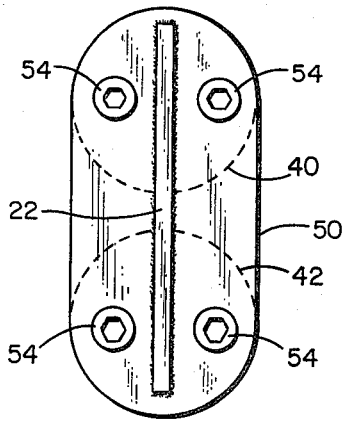

FIGS. 4A and 4B show a preferred embodiment of a typical threaded spring insert 40, which is used both in the four-way flex connector of FIGS. 3A and 3B and of FIGS. 5A and 5B. As shown in FIGS. 4A and 4B, threaded insert 40 has external threads 44 which are of a size, spacing and pitch which matches and mates with the coils of the second end of coil spring 24. Also shown in FIGS. 4A and 4B are internally threaded holes 46 which receive a screw. Although not used in the embodiment shown in FIGS. 3A and 3B, a connection using screws and threaded bolts 46 rather than welds may be made, as is illustrated in FIGS. 5A and 5B.

The embodiment shown in FIGS. 5A and 5B includes end plates 48 and 50 which are welded to the ends of connection plates 20 and 22, respectively. Screws 52 pass through four holes in plate 48 and into threaded holes 46 within inserts 36 and 38 to connect inserts 36 and 38 to plate 48. Similarly, four screws 54 pass through holes in plate 50 and are threaded into threaded holes 46 within inserts 40 and 42 to connect inserts 40 and 42 to plate 50.

In successful embodiments of the type shown in FIGS. 3A and 3B, and FIGS. 5A and 5B, coil springs 24 and 26 had a 5/16 inch wire size, $2\frac{1}{2}$ inch outside diameter, a 13 5/16 inch free length with plain ends. First and second connection plates 20 and 22 were $\frac{1}{4}$inch$\times$ 5 inch$\times$6 or 8 inch hot rolled, low carbon steel. Threaded spring inserts 36, 38, 40, and 42 were made from hot rolled, low carbon steel and had 2 5/16 inch diameter and a length of $1\frac{1}{2}$ inches. The threads of inserts 36, 38, 40, and 42 match and fit snugly within the ends of springs 24 and 26. In the embodiment which utilized end plates 48 and 50, these plates were $\frac{1}{4}$ inch$\times$3 inch$\times$6, $6\frac{1}{2}$ or 8 inch hot rolled, low carbon steel.

In still another embodiment (not shown), end plates similar to end plates 48 and 50 shown in FIGS. 5A and 5B were used in conjunction with inserts similar to inserts 28, 30, 32, and 34 shown in FIGS. 2A and 2B. In this embodiment, the inserts were connected to the end plates by screws, in a manner similar to that shown in FIGS. 5A and 5B.

In conclusion, the present invention is a highly advantageous parking lot gate which prevents unnecessary breakage of the gate arm and of the arm drive mechanism. The invention is useful not only in new equipment, but may also be used to convert existing parking lot gates.

Although the present invention has been described with reference to the preferred embodiments, workers skilled in the art will recognize that changes may be made in form and detail without departing from the scope and sprit of the invention.

What is claimed is:

1. A parking lot gate for selectively blocking a path of a vehicle, the parking lot gate comprising:

an elongated gate arm for blocking the path when in an essentially horizontal position and being pivotable about a pivot axis in an essentially vertical plane to an upraised position out of the path;

arm drive means for selectively pivoting the gate arm about the pivot axis;

a first connection plate connected to the arm drive means;

a second connection plate connected to the gate arm;

a first coil spring having a first end connected to the first connection plate and a second end connected to the second connection plate;

a second coil spring having a first end connected to the first connection plate and a second end connected to the second connection plate, the first and second coil springs being positioned essentially parallel to one another in an essentially vertical plane;

first connecting means for connecting the first ends of the first and second coil springs to the first plate, wherein the first connecting means comprises first inserts which extend into and are welded to the first ends of the first and second coil springs and are connected to first connection plate; and second connecting means for connecting the second ends of the first and second coil springs to the second plate, and wherein the second connecting means comprise second inserts which extend into and are welded to the second ends of the first and second coil springs and are connected to the second connection plate.

2. The parking lot gate of claim 1 wherein the first and second coil springs have a combined strength in the vertical plane sufficient to maintain the elongated gate arm in its essentially horizontal position, but individually do not have strength in the vertical plane sufficient to maintain the gate arm in an essentially horizontal position.

3. The parking lot gate of claim 1 wherein the first and second connecting means further comprise:

third and fourth plates attached essentially orthogonal to the first and second plates, respectively and wherein the first inserts are connected to the third plate and the second inserts are connected to the fourth plate.

4. The parking lot gate of claim 3 wherein the first and second inserts have internally threaded means, wherein the third and fourth plates have holes extending therethrough, and wherein threaded fasteners extend through the holes and engage the internally threaded means of the first and second inserts to connect the first and second inserts to the third and fourth plates respectively.

5. The parking lot gate of claim 1 wherein the first and second coil springs are tightly wound coil springs.

6. The parking lot gate of claim 5 wherein the tightly wound coil springs are torsion springs.

7. For use with a parking lot gate of the type having arm drive means which automatically and selectively pivots an elongated gate arm about a pivot axis in an essentially vertical plane from an essentially horizontal position which blocks a path of a vehicle to an upraised position out of the path, the improvement comprising:

a first vertically oriented connection plate for connection to the arm drive means;

a second vertically oriented connection plate for connection to the gate arm;

first and second coil springs each having a first end and a second end, the first and second coil springs being positioned essentially parallel to one another in an essentially vertical plane;

third and fourth vertically oriented plates attached essentially orthogonal to the first and second plates, respectively;

first inserts which extend into and are connected to the first ends of the first and second coil springs and are connected to the third plate; and second inserts which extend into and are connected to the second ends of the first and second coil springs and are connected to the fourth plate.

8. The invention of claim 7 wherein the first and second inserts have internally threaded means, wherein the third and fourth plates have holes extending therethrough, and wherein threaded fasteners extend through the holes and engage the internally threaded means of the first and second inserts to connect the first and second inserts to the third and fourth plates respectively.

9. The invention of claim 8 wherein the first and second coil springs are tightly wound coil springs.

10. For use with a parking lot gate of the type having arm drive means which automatically and selectively pivots an elongated gate arm about a pivot axis in an essentially vertical plane from an essentially horizontal position which blocks a path of a vehicle to an upraised position out of the path, the improvement comprising:

spring means connected between the arm drive means and the gate arm, the spring means having greater flexibility in the horizontal plane than in the vertical plane when the gate arm is in an essentially horizontal position, so that the gate arm is held securely in the essentially horizontal position, but is flexible in the horizontal plane to permit a vehicle to drive through the path without breaking the gate arm or the arm drive means, wherein the spring means comprises first and second tightly wound coil springs positioned essentially parallel to one another in an essentially vertical plane and connected between the arm drive means and the gate arm, the first and second springs having central axes oriented essentially parallel to the elongated direction of the elongated gate arm.

11. The invention of claim 10 wherein the spring means further comprises a first connection plate for connection to the arm drive means, a second connection plate for connection to the gate arm, and means for connecting first ends of the first and second coil springs to the first connection plate and second ends of the first and second coil springs to the second connection plate.

12. A parking lot gate for selectively blocking a path of a vehicle, the parking lot gate comprising:

an elongated gate arm for blocking the path when in an essentially horizontal position and being pivotable about a pivot axis in an essentially vertical plane to an upraised position out of the path;

arm drive means for selectively pivoting the gate arm about the pivot axis;

a first connection plate connected to the arm drive means;

a second connection plate connected to the gate arm;

a first coil spring having a first end and a second end;

a second coil spring having a first end and a second end, the first and second coil springs being positioned essentially parallel to one another in an essentially vertical plane;

first and second inserts having externally threaded portions to receive the first and second ends, respectively, of the first and second coil springs; and means for connecting the first and second inserts to the first and second plates, respectively.

13. A parking lot gate for selectively blocking a path of a vehicle, the parking lot gate comprising:

an elongated gate arm for blocking the path when in an essentially horizontal position and being pivotable about a pivot axis in an essentially vertical plane to an upraised position out of the path;

arm drive means for selectively pivoting the gate arm about the pivot axis;

a first connection plate connected to the arm drive means;

a second connection plate connected to the gate arm;

a first coil spring having a first end and a second end;

a second coil spring having a first end and a second end, the first and second coil springs being positioned essentially parallel to one another in an essentially vertical plane;

first inserts which extend into and are connected to the first ends of the first and second coil springs;

second inserts which extend into and are connected to the second ends of the first and second coil springs; and third and fourth plates attached essentially orthogonal to the first and second plates, and wherein the first inserts are connected to the third plate and the second inserts are connected to the fourth plate.

14. The parking lot gate of claim 13 wherein the first and second inserts have internally threaded means, wherein the third and fourth plates have holes extending therethrough, and wherein threaded fasteners extend through the holes and engage the internally threaded means of the first and second inserts to connect the first and second inserts to the third and fourth plates, respectively.

15. A parking lot gate for selectively blocking a path of a vehicle, the parking lot gate comprising:

an elongated gate arm for blocking the path when in an essentially horizontal position and being pivotable about a horizontal pivot axis in an essentially vertical plane perpendicular to the horizontal pivot axis to an upraised position out of the path;

arm drive means for selectively pivoting the gate arm about the pivot axis;

a first veritcally oriented connection plate connected to the arm drive means and generally parallel to the vertical plane;

a second vertically oriented connection plate connected to the gate arm and generally parallel to the vertical plane;

a first coil spring having a first end connected to the first connection plate and a second end connected to the second connection plate; and a second coil spring having a first end connected to the first connection plate and a second end connected to the second connection plate, the first and second coil springs having first and second central axes, respectively, positioned essentially parallel to one another in an essentially vertical plane and oriented essentially in the elongated direction of the elongated gate arm.

* * * * *